US005730358A

United States Patent [19]

Raghavan et al.

[11] Patent Number: 5,730,358

[45] Date of Patent: Mar. 24, 1998

[54] TUNABLE ULTRAHIGH-PRESSURE NOZZLE

[75] Inventors: Chidambaram Raghavan, Kent; Curtis L. Anderson, Puyallup; Richard F. Schmid, Renton, all of Wash.

[73] Assignee: Flow International Corporation, Kent, Wash.

[21] Appl. No.: 577,431

[22] Filed: Dec. 22, 1995

[51] Int. Cl.[6] ..... B05B 17/00; B05B 1/00

[52] U.S. Cl. ..... 239/1; 239/596; 239/602; 239/DIG. 19

[58] Field of Search ..... 239/589, 596, 239/601, 602, DIG. 19, 1

[56] References Cited

U.S. PATENT DOCUMENTS

| | | | |
|---|---|---|---|
| 4,150,794 | 4/1979 | Higgins | 239/596 |
| 4,421,722 | 12/1983 | Massey et al. | 239/602 X |
| 4,660,773 | 4/1987 | O'Hanlon | 239/596 |
| 4,806,172 | 2/1989 | Adaci et al. | 239/589 X |
| 4,852,800 | 8/1989 | Murdock | 239/1 |
| 4,936,512 | 6/1990 | Tremoulet, Jr. | 239/596 |
| 5,033,681 | 7/1991 | Munoz | 239/596 |
| 5,226,597 | 7/1993 | Ursic | 239/11 |

FOREIGN PATENT DOCUMENTS

| | | | |
|---|---|---|---|
| 1376591 | 12/1974 | United Kingdom | 239/596 |
| 2178342 | 2/1987 | United Kingdom | 239/596 |

*Primary Examiner*—Lesley D. Morris
*Attorney, Agent, or Firm*—Seed and Berry LLP

[57] ABSTRACT

An improved and tunable ultrahigh-pressure nozzle for use in generating ultrahigh-pressure fluid jets is shown and described. In a preferred embodiment, a nozzle body is provided with a first conical bore that extends from an entrance orifice to an exit orifice, the bore transitioning into a second conical bore that is formed in a seal. The seal is formed to capture a nozzle orifice and position it in the nozzle body adjacent the exit orifice. By selecting the geometry of the nozzle, namely the diameter of the entrance orifice, and an included angle of the first and second conical bores, it is possible to optimize performance of a fluid jet generated by the nozzle for a selected task and operating parameters.

17 Claims, 3 Drawing Sheets

TUNABLE ULTRAHIGH-PRESSURE NOZZLE

TECHNICAL FIELD

This invention relates to nozzles, and more particularly, to nozzles for generating ultrahigh-pressure fluid jets.

BACKGROUND OF THE INVENTION

Numerous tasks, for example, cutting, cleaning and surface preparation, may be accomplished through the use of a stream of pressurized fluid, typically water, generated by high-pressure, positive displacement pumps or other suitable means. Such pumps pressurize a fluid by having a reciprocating plunger that draws a volume of fluid from an inlet area into a pressurization chamber during an intake stroke, and acts against the fluid during a pumping stroke, thereby forcing pressurized fluid to pass from the pressurization chamber into an outlet chamber, from which it is collected into a manifold. The pressurized fluid is then directed through a nozzle of a tool, thereby creating an ultrahigh-pressure fluid jet that may be used to perform a particular task, for example, cutting a variety of materials or cleaning a surface. Such jets may reach pressures up to and beyond 55,000 psi.

It is desirable to maximize the effectiveness of the fluid jet in its performance of a selected task. Although currently available nozzles produce good results, applicants believe that it is possible and desirable to provide an improved nozzle.

SUMMARY OF THE INVENTION

It is therefore an object of this invention to provide an improved nozzle for generating an ultrahigh-pressure fluid jet.

It is another object of this invention to provide a nozzle that may be tuned to maximize its performance for a given set of operating conditions.

It is another object of this invention to provide an ultrahigh-pressure nozzle that is more simple to use than currently available systems.

These and other objects of the invention, as will be apparent herein, are accomplished by providing an improved ultrahigh-pressure nozzle. In a preferred embodiment, a nozzle body is provided having an entrance orifice and an exit orifice, and a bore extending from the entrance orifice to the exit orifice. A seal is provided in the bore adjacent the exit orifice, the seal having a first conical bore at a first upstream end and a second bore at a second downstream end, the first and second bores being adjacent to each other. The second bore of the seal is sized to accommodate a nozzle orifice that is held in place in the assembly by the seal. As a result, when the nozzle is used, a volume of pressurized fluid flows through the entrance orifice of the nozzle body, through the bore of the nozzle body and through the conical bore of the seal, prior to flowing through the nozzle orifice to exit the nozzle body as an ultrahigh-pressure fluid jet.

In a preferred embodiment, a diameter of the entrance orifice is 0.1–0.75 inch, an included angle of the bore of the nozzle body is 0°–20°, and an included angle of the first conical bore of the seal is 30°–170°. By adjusting these three parameters within the given ranges, it is possible to tune the nozzle to optimize its performance at a selected stand-off distance.

More particularly, it is believed that a fluid jet transitions from a coherent state near the exit of a nozzle into high velocity, large droplets at some distance from the orifice, and that the droplets then slow down and break up at some greater distance from the exit orifice. A fluid jet may therefore be thought of as transitioning through three zones after it exits a nozzle, namely, a coherent zone, a high velocity, large droplet zone, and a low velocity, small droplet zone. It is believed that the contact stresses are greater in the second zone, and that superior surface preparation results are therefore achieved by placing a surface to be treated in the second zone.

However, the stand-off distance, or distance between the exit orifice of a nozzle and a surface to be treated, may be dictated by operating conditions. For example, if a nozzle is used in a hand-held tool, the stand-off distance will vary, and may average approximately 4 inches. In a different context, given space constraints or other considerations, it may be necessary to operate at a specified stand-off distance. Applicants believe that by providing a nozzle in accordance with a preferred embodiment of the present invention, they may alter the turbulence in the fluid jet generated by the nozzle by adjusting the three parameters identified above, namely, the diameter of the entrance orifice of the nozzle, the included angle of the bore of the nozzle body, and the included angle of a second conical bore. In this manner, the distance from the exit nozzle at which the ultrahigh-pressure fluid jet begins to transition from a zone 1 coherent jet to a zone 2 jet having a coherent core and large velocity droplets may be set at a desired value, thereby ensuring that performance of the fluid jet is optimized at a pre-selected stand-off distance.

In a preferred embodiment, a smallest diameter of the bore of the nozzle body and a smallest diameter of the conical bore of the seal are both at least as large as an outer diameter of the nozzle orifice, such that the nozzle orifice may be easily pushed out of the nozzle body and replaced as necessary.

Furthermore, in a preferred embodiment, an exterior surface of the nozzle body is formed to have at least one flat surface. As a result, any cracks that may result from the cycling of pressure through the nozzle body will propagate to the flat surface, causing the nozzle to leak, rather than break. Applicant further believes that preferable results are achieved when the exterior surface of the nozzle body is formed into a hexagon measuring at least ⅜ inch in width between two parallel faces.

DETAILED DESCRIPTION OF THE INVENTION

Numerous tasks such as curing, cleaning or preparing a surface may be accomplished through use of an ultrahigh-pressure fluid jet, generated by forcing a volume of pressurized fluid through a nozzle. The nozzle may be provided in a machine operated tool or in a hand-held tool. This condition, as well as operating considerations such as space constraints or safety issues, may dictate an operating stand-off distance, namely, the distance between an exit of a nozzle and the surface to be treated.

Figure 1:
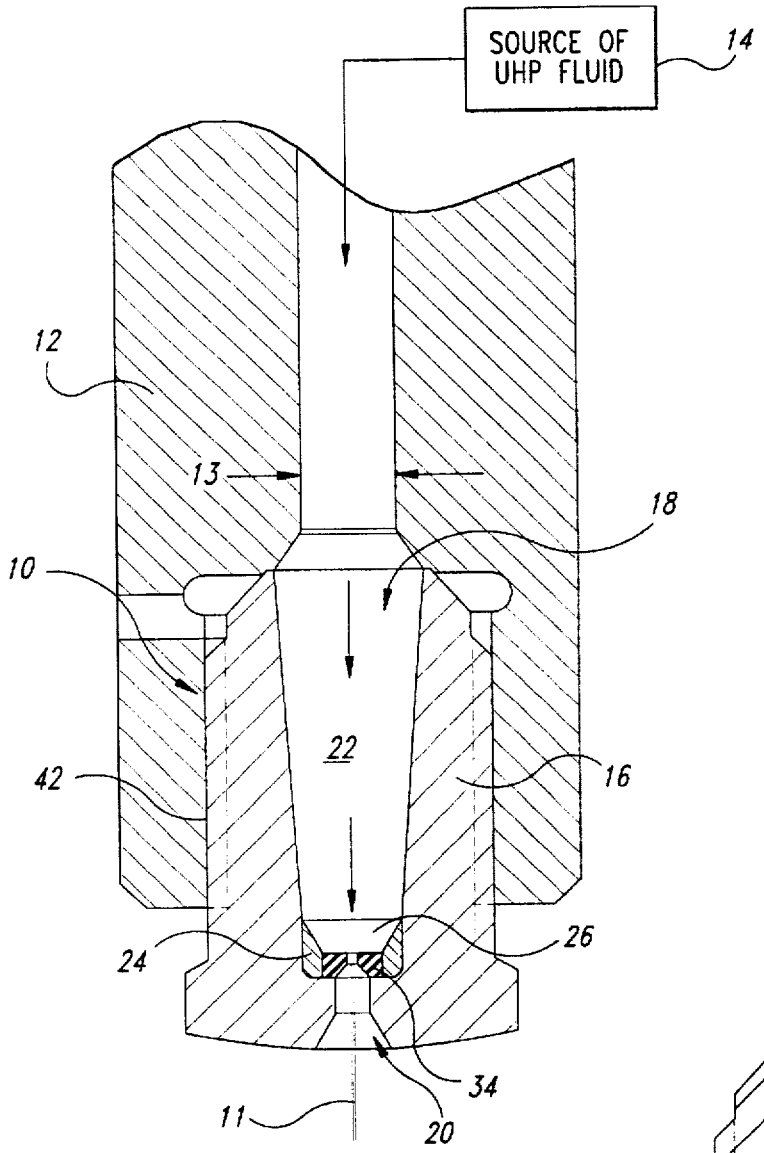
FIG. 1 is a cross-sectional elevational view of a nozzle assembly provided in accordance with a preferred embodiment of the present invention, illustrated in the context of an ultrahigh-pressure fluid jet system.
Figure 2:
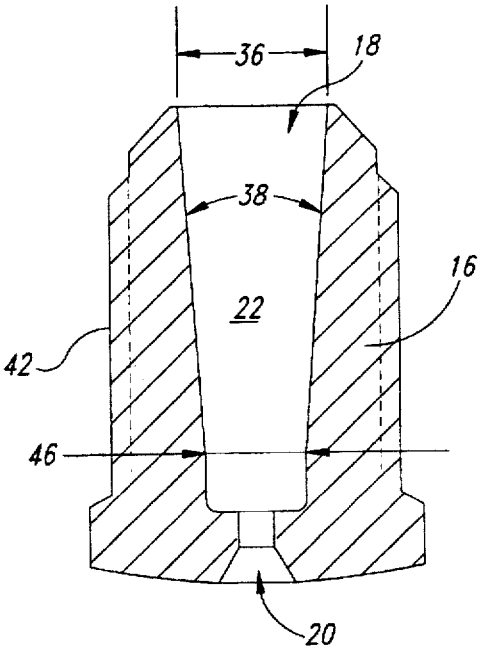
FIG. 2 is a cross-sectional elevational view of a nozzle body of FIG. 1.

An improved ultrahigh-pressure nozzle 10 is provided in accordance with a preferred embodiment of the present invention. As illustrated in FIG. 1, a volume of pressurized fluid from a source of ultrahigh-pressure fluid 14 is provided to the nozzle 10 via supply tube 12. The nozzle 10 is comprised of a nozzle body 16 having an entrance orifice 18 and an exit orifice 20. As illustrated in FIGS. 1 and 2, a bore 22 is provided in the nozzle body 16, extending from the entrance orifice 18 to the exit orifice 20.

Figure 3:
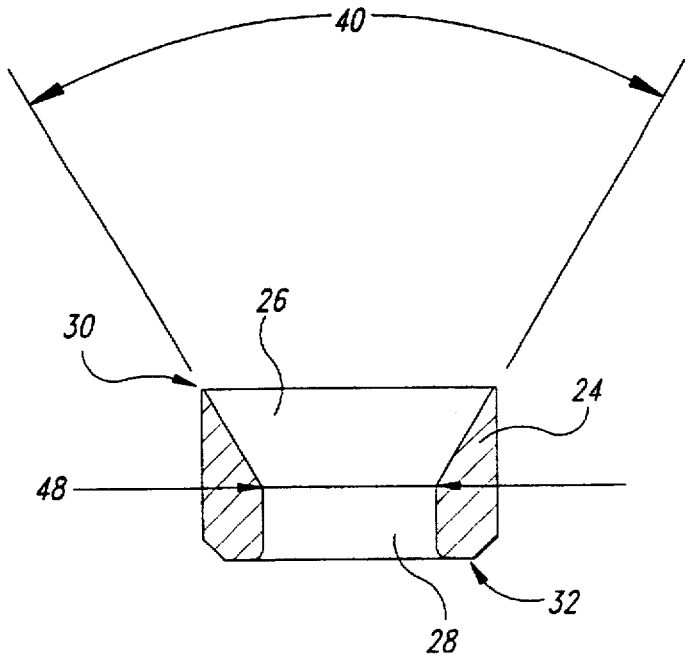
FIG. 3 is a cross-sectional elevational view of a portion of the nozzle assembly of FIG. 1.
Figure 4:
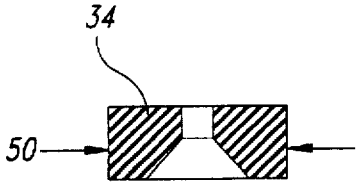
FIG. 4 is a cross-sectional elevational view of a nozzle orifice, used in the nozzle assembly of FIG. 1.

As illustrated in FIGS. 1 and 3, a seal 24 is provided having a first conical bore 26 at a first upstream end 30, and a second bore 28 at a second downstream end 32. A nozzle orifice element 34 having an aperture extending therethrough and referred to hereinafter as a nozzle orifice is positioned in the second bore 28 of the seal 24, the seal 24 and nozzle orifice 34 being positioned in the bore 22 of the nozzle body 16 such that the bore 22 of the nozzle body is adjacent the first conical bore 26 of the seal, and the nozzle orifice 34 is adjacent the exit orifice 20. In a preferred embodiment, the second bore 28 of the seal 24 is cylindrical, and is sized according to an outer diameter 50 of the nozzle orifice 34, as illustrated in FIG. 4. Although a variety of materials may be used, in a preferred embodiment, seal 24 is made of Delrin, and the seal captures the nozzle orifice and holds it in position in the nozzle 10.

An ultrahigh-pressure fluid jet 11 is therefore generated in accordance with a preferred embodiment of the present invention by forcing a volume of pressurized fluid through the entrance orifice 18 of nozzle body 16 via supply tube 12. The pressurized fluid flows through first conical bore 22 and a second conical bore formed by the first bore of the seal 24, the pressurized fluid flowing through nozzle orifice 34 to exit the nozzle body 16 via exit orifice 20 as an ultrahigh-pressure fluid jet 11.

Although applicants do not intend for the scope of their invention to be bound by any theoretical basis for the improved results, it is believed that the fluid jet 11 transitions from a coherent and transparent state near the exit orifice 20 into a jet having a coherent core surrounded by high velocity large droplets at some distance from the exit orifice 20. It is further believed that the droplets then slow down and break up at some greater distance from the exit orifice, such that the fluid jet 11 may be thought of as transitioning through three zones after it exits the nozzle 10. The fluid jet 11 is most effective at cutting materials of low yield strength, such as plastics, paper, cardboard, etc., in zone 1, while increased contact stresses and a water hammer effect caused by the impact of droplets on a surface make the second zone more effective in cutting granular materials such as rock and in surface cleaning and preparation.

Given a particular task, therefore, it is desirable to ensure that the surface to be treated is impacted by the zone of the fluid jet that is most effective for the given task. As noted above, however, the stand-off distance may be set, given operating conditions. However, by providing a nozzle in accordance with a preferred embodiment of the present invention, the nozzle may be tuned such that the resulting high-pressure fluid jet will transition from zone 1 to zone 2 at a desired distance from the exit orifice, thereby ensuring that a selected portion of the fluid jet performs the given task, thereby optimizing the performance of the fluid jet.

This tuning of the nozzle is accomplished in accordance with the preferred embodiment of the present invention, by selecting a diameter 36 of the entrance orifice 18, and by selecting an included angle 38 of bore 22 and an included angle 40 of bore 26. In a preferred embodiment, the diameter 36 of entrance orifice 18 is 0.1–0.75 inch, the included angle 38 of bore 22 is 0°–20°, and the included angle 40 of bore 26 is 30°–170°, with superior results being achieved when the diameter 36 is 0.18–0.22 inch, angle 38 is 5°–11° and angle 40 is 40°–80°.

A series of tests were carried out to evaluate the relative effectiveness of several ultrahigh-pressure fluid jets generated by nozzles having different geometries, in eroding an aluminum target. For example, with a stand-off distance of 2 inches, a nozzle provided in accordance with the present invention having an entrance orifice diameter of 0.25 inch, an included angle 38 of bore 22 of 0° and an included angle 40 of bore 26 of 90°, outperformed all other geometries tested, thereby optimizing performance for the selected stand-off. In contrast, when the stand-off distance was set at 4 inches, a nozzle having an entrance orifice diameter of 0.2 inch, an included angle 38 of bore 22 of 8°, and an included angle 40 of bore 26 of 60° outperformed the other geometries tested, including prior art nozzles. (It should be noted that these results were achieved through use of a supply tube having a standard inner diameter 13 of 0.141 inch.)

It is therefore possible to tone the nozzle of the present invention by providing a nozzle body 16 as described above, step 52, and providing a nozzle orifice 34 that is sized for the selected task, step 54. Once the desired stand-off distance is selected, step 56, it is possible to size the diameter of the entrance orifice and select and form included angles for the bore 22 and bore 28, step 58, such that an ultrahigh-pressure fluid jet formed by the nozzle will begin to break up into high velocity droplets prior to or upon reaching the surface to be treated, thereby optimizing the performance of the nozzle. Conventional methods of manufacture and milling may be used to create the desired entrance diameter and included angles in the nozzle.

As further illustrated in FIGS. 1–3, in a preferred embodiment, a smallest diameter 46 of bore 22 and a smallest diameter 48 of bore 26 are both at least as large as outer diameter 50 of nozzle orifice 34, such that the nozzle orifice 34 may be easily removed from the nozzle body 16 and replaced, without removing seal 24. The nozzle orifice 34 is therefore easily replaceable, in contrast to currently available systems. Although the outer diameter 50 of nozzle orifice 34 may vary, in a preferred embodiment, a standard nozzle orifice having an outer diameter of 0.078 inch is used. For applications requiring more horsepower, a larger nozzle orifice having an outer diameter of 3/16 inch is used.

Figure 5:
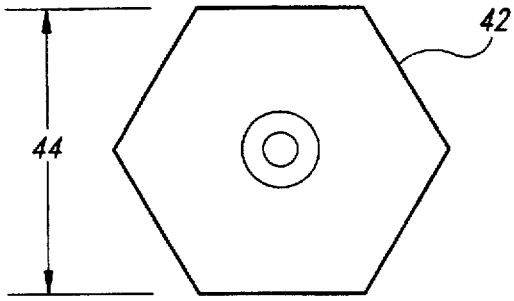
FIG. 5 is a bottom plan view of the nozzle assembly of FIG. 1.
Figure 6:
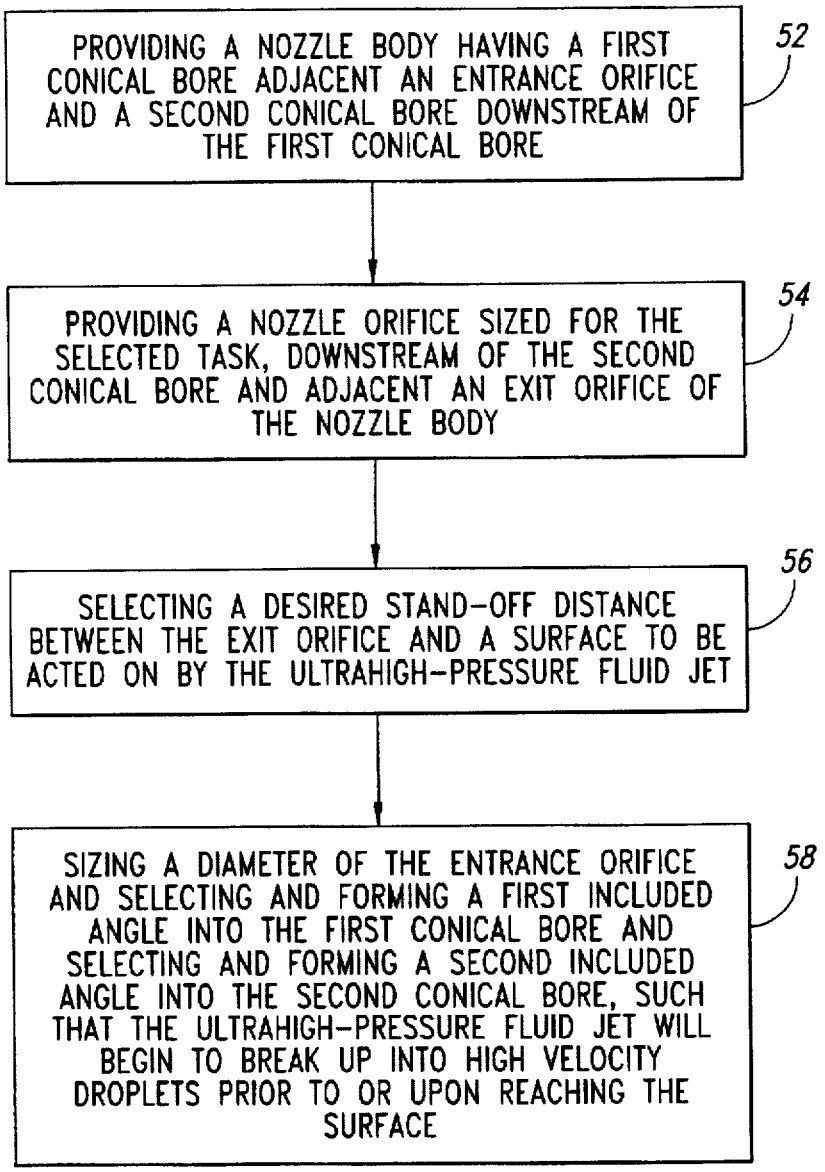
FIG. 6 is a schematic drawing illustrating the steps of a preferred embodiment of the present invention.

As illustrated in FIG. 5, an outer surface 42 of nozzle body 16 is formed into a hexagon, having a width 44 of at least 3/8 inch between two parallel faces. In operation, the nozzle is typically subjected to numerous pressure cycles, which may result in cracks that propagate through the nozzle body. By providing the outer surface 42 in the form of a hexagon, a crack will not uniformly reach the outer boundary of the nozzle body, but rather will reach a flat face of the hexagon causing the nozzle body 16 to leak while the tips of the hexagon hold the structure together. This leakage may be observed and will cause a pressure drop in the system, thereby signaling the operator to change the nozzle. This benefit is also achieved by forming the outer surface 42 of the nozzle body 16 to have at least one flat surface.

In a preferred embodiment, as illustrated in FIG. 1, the diameter 36 of entrance orifice 18 is larger than the inner diameter 13 of supply tube 12, thereby resulting in superior fluid jet performance. Again, although applicants' invention is not dependent on any theory, applicants believe that by generating turbulence at the step between the supply tube 12 and the bore 22 of nozzle body 16, and then damping the turbulence via the internal geometry of nozzle 10, that superior results are achieved. In a preferred embodiment, however, the ratio of the supply tube inner diameter 13 to the nozzle entrance diameter 36 is 0.5–1.

An improved and tunable ultrahigh-pressure nozzle, and a method for making such a nozzle, is shown and described. From the foregoing, it will be appreciated that although embodiments of the invention have been described herein for purposes of illustration, various modifications may be made without deviating from the spirit and scope of the invention. Thus, the present invention is not limited to the embodiments described herein, but rather as defined by the claims which follow.

We claim:

1. A method for tuning an ultrahigh-pressure nozzle to optimize performance of a selected task by an ultrahigh-pressure fluid jet generated by forcing a volume of fluid through the nozzle, comprising:

providing a nozzle body having a first conical bore adjacent an entrance orifice and a second conical bore downstream of the first conical bore;

providing a nozzle orifice sized for the selected task, downstream of the second conical bore and adjacent an exit orifice of the nozzle body;

selecting a desired stand-off distance between the exit orifice and a surface to be acted on by the ultrahigh-pressure fluid jet; and sizing a diameter of the entrance orifice and selecting and forming a first included angle into the first conical bore and selecting and forming a second included angle into the second conical bore, such that the ultrahigh-pressure fluid jet will begin to break up into high velocity droplets prior to or upon reaching the surface.

2. A method for performing a selected task with an ultrahigh-pressure fluid jet generated by forcing a volume of pressurized fluid through a nozzle, comprising:

selecting a stand-off distance between an exit orifice of the nozzle and a surface to be treated;

providing a nozzle orifice sized for the selected task;

providing a nozzle body;

selecting a diameter of an entrance orifice to be provided in the nozzle body, and selecting a first included angle of a first conical bore and selecting a second included angle of a second conical bore, both the first and second conical bores to be provided in the nozzle body;

providing an entrance diameter in the nozzle body having the selected diameter and providing a first conical bore and a second conical bore in the nozzle body, having the first and second selected included angles, respectively, such that an ultrahigh-pressure fluid jet generated by the nozzle will begin to break up into high velocity droplets prior to or upon reaching the surface;

inserting the nozzle orifice into the nozzle body downstream of the second conical bore and upstream of the exit orifice;

forcing a volume of pressurized fluid through the nozzle to generate the ultrahigh-pressure fluid jet; and performing the selected task.

3. An ultrahigh-pressure nozzle comprising:

a nozzle body having an entrance orifice and an exit orifice and a bore extending from the entrance orifice to the exit orifice;

a seal provided in the bore adjacent the exit orifice, the seal having a first, conical bore at a first upstream end and a second bore at a second downstream end, the first and second bores being adjacent to each other; and a nozzle orifice provided in the second bore of the seal such that the nozzle orifice is adjacent the exit orifice and has an upstream surface at least partially adjacent to and at least approximately perpendicular to flow entering the nozzle orifice and a downstream surface opposite the upstream surface and at least partially adjacent to flow exiting the nozzle orifice, the downstream surface engaging the nozzle body.

4. The nozzle according to claim 3 wherein a diameter of the entrance orifice is 0.1–0.75 inch, an included angle of the bore of the nozzle body is 0°–20°, and an included angle of the first conical bore is 30°–170°.

5. The nozzle according to claim 3 wherein a diameter of the entrance orifice is 0.18–0.22 inch, an included angle of the bore of the nozzle body is 5°–11°, and an included angle of the first conical bore is 40°–80°.

6. The nozzle according to claim 3 wherein an outer surface of the nozzle is formed to include at least one flat surface.

7. The nozzle according to claim 3 wherein an outer surface of the nozzle body is formed into a hexagon measuring at least ⅜ inch in width between two parallel faces.

8. The nozzle according to claim 3 wherein a smallest diameter of the bore of the nozzle body and the smallest diameter of the first conical bore of the seal are both at least as large as an outer diameter of the nozzle orifice, such that the nozzle orifice may be easily removed and inserted into the nozzle.

9. The nozzle according to claim 3 wherein a diameter of the entrance orifice is 0.2 inch, an included angle of the bore of the nozzle body is 8°, and an included angle of the first conical bore is 60°.

10. The nozzle according to claim 3 wherein a diameter of the entrance orifice is 0.25 inch, an included angle of the bore of the nozzle body is 0°, and an included angle of the first conical bore is 90°.

11. The nozzle according to claim 3 wherein a diameter of the entrance orifice is 0.2 inch, an included angle of the bore of the nozzle body is 8°, and an included angle of the first conical bore is 60°, the nozzle being coupleable to a source of ultrahigh-pressure fluid to produce a fluid jet which will begin to break up into high velocity droplets prior to or upon reaching a surface approximately four inches from the exit orifice.

12. The nozzle according to claim 3 wherein a diameter of the entrance orifice is 0.25 inch, an included angle of the bore of the nozzle body is 0°, and an included angle of the first conical bore is 90°, the nozzle being coupleable to a source of ultrahigh-pressure fluid to produce a fluid jet which will begin to break up into high velocity droplets prior to or upon reaching a surface approximately two inches from the exit orifice.

13. An ultrahigh-pressure nozzle comprising:

a nozzle body having an entrance orifice and an exit orifice and a bore extending from the entrance orifice to the exit orifice, the bore having a first conical section adjacent the entrance orifice that transitions into a second conical section in a downstream direction, the entrance orifice having a diameter of 0.1–0.75 inch, the first conical section having an included angle of 0°–20°, and the second conical section having an included angle of 30°–170°; and a nozzle orifice provided downstream of the second conical section, the nozzle orifice having an upstream surface at least partially adjacent to and at least approximately perpendicular to flow entering the nozzle orifice and a downstream surface opposite the upstream surface and at least partially adjacent to flow exiting the nozzle orifice, the downstream surface engaging the nozzle body, and wherein a smallest diameter of the second conical section is at least as large as an outer diameter of the nozzle orifice.

14. The nozzle according to claim 13 wherein an outer surface of the nozzle is formed to include at least one flat surface.

15. The nozzle according to claim 13, wherein an outer surface of the nozzle body is formed into a hexagon measuring at least ⅜ inch in width between two parallel faces.

16. An ultrahigh-pressure nozzle for use in a system to generate an ultrahigh-pressure fluid jet by providing a volume of pressurized fluid to the nozzle via a supply tube comprising:

a nozzle body having an entrance orifice and an exit orifice and a bore extending from the entrance orifice to the exit orifice, the entrance orifice being adjacent the supply tube, a ratio of an inner diameter of the supply tube to a diameter of the entrance orifice being 0.5–1, the bore having a first conical section adjacent the entrance orifice that transitions into a second conical section in a downstream direction, the first conical section having an included angle of 0°–20°, and the second conical section having an included angle of 30°–170°; and a nozzle orifice provided downstream of the second conical section, the nozzle orifice having an upstream surface at least partially adjacent to and at least approximately perpendicular to flow entering the nozzle orifice and a downstream surface opposite the upstream surface and at least partially adjacent to flow exiting the nozzle orifice, the downstream surface engaging the nozzle body.

17. An ultrahigh-pressure nozzle comprising:

a nozzle body having an entrance orifice and an exit orifice and a bore extending from the entrance orifice to the exit orifice, the bore having a first conical section adjacent the entrance orifice that transitions into a second conical section in a downstream direction, the entrance orifice having a, diameter of 0.18–0.22 inch, the first conical section having an included angle of 5°–11°, and the second conical section having an included angle of 40°–80°; and a nozzle orifice provided downstream of the second conical section, the nozzle orifice having an upstream surface at least approximately perpendicular to flow entering the nozzle orifice and a downstream surface opposite the upstream surface and at least partially adjacent to flow exiting the nozzle orifice, the downstream surface engaging the nozzle body, and wherein a smallest diameter of the second conical section is at least as large as an outer diameter of the nozzle orifice.

* * * * *